US012735897B2

(12) United States Patent
Hannig et al.

(10) Patent No.: US 12,735,897 B2
(45) Date of Patent: Sep. 15, 2026

(54) SET CONSISTING OF TWO PANELS FOR CLADDING A SURFACE AND OF A PANEL CONNECTION ELEMENT, PANEL CONNECTION ELEMENT, AND USE OF A PANEL CONNECTION ELEMENT

(71) Applicant: SURFACE TECHNOLOGIES GMBH & CO. KG, Baruth (DE)

(72) Inventors: Hans-Jürgen Hannig, Bergisch Gladbach (DE); Andreas Sieder, Ludwigsfelde (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 277 days.

(21) Appl. No.: 18/697,652

(22) PCT Filed: Dec. 28, 2022

(86) PCT No.: PCT/EP2022/087977
§ 371 (c)(1),
(2) Date: Apr. 1, 2024

(87) PCT Pub. No.: WO2023/126456
PCT Pub. Date: Jul. 6, 2023

(65) Prior Publication Data

US 2025/0230668 A1 Jul. 17, 2025

(30) Foreign Application Priority Data

Dec. 30, 2021 (DE) ..... 20 2021 003 901.5

(51) Int. Cl.
*E04B 2/00* (2006.01)
*E04F 13/08* (2006.01)
*E04F 15/02* (2006.01)

(52) U.S. Cl.
CPC .... *E04F 13/0894* (2013.01); *E04F 15/02038* (2013.01); *E04F 2201/0535* (2013.01);
(Continued)

(58) Field of Classification Search
CPC ..... E04F 13/0894; E04F 15/02038; E04F 2201/0535; E04F 2201/0547
See application file for complete search history.

(56) References Cited

U.S. PATENT DOCUMENTS

D265,687 S 8/1982 Bowman
4,972,640 A 11/1990 DiFazio
(Continued)

FOREIGN PATENT DOCUMENTS

DE 102011122086 A1 6/2013
WO 2007/008139 A1 1/2007
WO 2019/238811 A1 12/2019

OTHER PUBLICATIONS

International Search Report (English and German) and Written Opinion of the ISA (German) issued in PCT/EP2022/087977, mailed Apr. 3, 2023; ISA/EP.
(Continued)

*Primary Examiner* — Basil S Katcheves
(74) *Attorney, Agent, or Firm* — Harness, Dickey & Pierce, P.L.C.

(57) ABSTRACT

The disclosure relates to a set consisting of two panels for cladding a surface and of a panel connection element for connecting the two panels, wherein: two mutually opposing panel side faces have mutually complementary coupling elements in the form of an upper coupling element and a lower coupling element; the lower coupling element has a groove; the panel connection element has a first part and a second part which is coupled to the first part via a connection piece; the first part is introduced into the groove when the
(Continued)

two panels are in the coupled state; the second part is pivotable about the connection piece relative to the first part; the second part comprises an upper portion, which has a latching element, and a lower portion, which has a lever, and the latching element has a bulge at the distal end; the locking element has a contact face which bears against the lever when the two panels are in the coupled state; the locking element has a latching receptacle which is complementary to the latching element and into which the bulge of the latching element engages when the two panels are in the coupled state. In this way, a set consisting of two panels and a panel connection element is provided which allows particularly fast and simple connection of the two panels via the panel connection element.

11 Claims, 4 Drawing Sheets

(52) U.S. Cl.
CPC ..... *E04F 2201/0576* (2013.01); *E04F 2201/0588* (2013.01)

(56) References Cited

U.S. PATENT DOCUMENTS

D597,909 S 8/2009 Schlater et al.
D606,474 S 12/2009 Schlater
7,726,088 B2 * 6/2010 Muehlebach ..... E04F 15/02 52/592.1
7,841,144 B2 * 11/2010 Pervan ..... F16B 5/0016 52/391
8,220,217 B2 * 7/2012 Muehlebach ..... E04F 15/02 52/592.1
8,381,476 B2 2/2013 Hannig
8,505,257 B2 8/2013 Boo et al.
8,596,013 B2 12/2013 Boo
8,689,512 B2 4/2014 Pervan
D757,660 S 5/2016 Ringer
9,556,620 B2 1/2017 Cappelle et al.
D791,350 S 7/2017 Singh
9,845,638 B1 12/2017 Cunningham
D834,729 S 11/2018 Lee
10,214,916 B2 * 2/2019 Schulte ..... E04F 15/02038
10,358,830 B2 7/2019 Pervan
D857,420 S 8/2019 Schneider et al.
10,458,124 B2 10/2019 Loebel et al.
10,508,457 B2 12/2019 Hannig et al.
D882,122 S 4/2020 Fisher et al.
10,612,248 B2 4/2020 Hannig et al.
10,876,301 B2 12/2020 Hannig et al.
D909,618 S 2/2021 Zhao
D932,797 S 10/2021 Schneider et al.
11,168,482 B2 11/2021 Hannig et al.
D966,764 S 10/2022 Siekmann
11,608,646 B2 3/2023 Schäfers et al.
D986,437 S 5/2023 Albino et al.
11,725,394 B2 8/2023 Pervan
11,987,992 B2 * 5/2024 Boo ..... E04F 13/0894
2008/0110125 A1 5/2008 Pervan
2009/0064624 A1 * 3/2009 Sokol ..... E04F 15/02 52/591.5
2009/0193748 A1 8/2009 Boo et al.
2010/0043333 A1 2/2010 Hannig
2011/0167751 A1 7/2011 Engstrom
2011/0271631 A1 * 11/2011 Engstrom ..... E04F 15/02005 52/582.2
2011/0271632 A1 11/2011 Cappelle et al.
2012/0055112 A1 3/2012 Engstrom
2012/0279161 A1 11/2012 Hakansson et al.
2013/0008117 A1 1/2013 Pervan
2013/0014463 A1 1/2013 Pervan
2013/0042562 A1 2/2013 Pervan et al.
2013/0042563 A1 2/2013 Pervan et al.
2013/0152500 A1 * 6/2013 Engstrom ..... E04F 15/02022 52/588.1
2013/0167467 A1 7/2013 Vermeulen et al.
2014/0290173 A1 * 10/2014 Hamberger ..... F16B 5/0016 52/582.2
2014/0305065 A1 10/2014 Pervan
2015/0176289 A1 6/2015 Hannig
2015/0300029 A1 * 10/2015 Pervan ..... E04F 15/02038 52/582.2
2015/0337542 A1 * 11/2015 Cappelle ..... E04F 15/10 52/309.1
2018/0002933 A1 1/2018 Pervan
2019/0169836 A1 6/2019 Fisher et al.
2019/0383026 A1 12/2019 Bergelin et al.
2020/0087926 A1 3/2020 Loebel
2020/0217084 A1 7/2020 Ylikangas et al.
2021/0238863 A1 8/2021 Sieder et al.
2022/0118644 A1 * 4/2022 De Rick ..... B27M 3/04
2022/0136257 A1 * 5/2022 Cappelle ..... E04F 15/02011 52/588.1
2022/0243482 A1 8/2022 Landgård et al.
2023/0183987 A1 6/2023 De Rick

OTHER PUBLICATIONS

Aug. 7, 2025. Notice of Ground for Rejection from corresponding Korean Application No. 10-2024-7013342.

* cited by examiner

SET CONSISTING OF TWO PANELS FOR CLADDING A SURFACE AND OF A PANEL CONNECTION ELEMENT, PANEL CONNECTION ELEMENT, AND USE OF A PANEL CONNECTION ELEMENT

CROSS-REFERENCE TO RELATED APPLICATIONS

This application is a U.S. National Phase Application under 35 U.S.C. 371 of International Application No. PCT/EP2022/087977, filed on Dec. 28, 2022, which claims the benefit of German Patent Application No. 20 2021 003 901.5, filed on Dec. 30, 2021. The entire disclosure of the above German patent application is incorporated herein by reference.

FIELD

The disclosure relates to a set consisting of two panels for cladding a surface and a panel connection element for connecting the two panels, wherein the panels each have a panel core which is enclosed by a flat panel upper surface, a flat panel lower surface spaced from and parallel to the plane panel upper surface and four panel side surfaces respectively connecting the panel upper surface to the panel lower surface, wherein coupling elements complementary to each other in the form of an upper coupling element and a lower coupling element are arranged at two mutually opposing panel side surfaces, wherein the coupling elements are configured in such a way that they enable a coupling of a first such panel to a second such panel by means of a relative movement of the upper coupling element of the first panel towards the lower coupling element of the second panel and a connection by means of the panel connection element. The disclosure also relates to a panel connection element and a use of such a panel connection element.

BACKGROUND

This section provides background information related to the present disclosure which is not necessarily prior art.

A panel, as described above, thus always has a lower coupling element and an upper coupling element, wherein the terms "lower" and "upper" refer to the fact that, during assembly of the panels, an upper coupling element of a panel to be mounted is pivoted down onto a lower coupling element of a panel already mounted and lying on a subsurface.

In order to couple the panels together, a locking element of the upper coupling element is inserted into the latching receptacle of the lower coupling element. The insertion is preferably carried out by means of a pivoting movement by means of which the upper coupling element is lowered into the lower coupling element. The lower coupling element comprises a panel connection element that is actuated by the locking element and connects the lower coupling element to the upper coupling element.

Conventional panels have panel connection elements that are arranged between the two panels to be connected in recesses provided for this purpose in order to ensure a high point stability and to prevent the combination of panels from jumping up in the head joint.

Particularly in the case of panels with a greater thickness, it may be that the panel connection elements known from the prior art do not provide sufficient retaining force in the vertical locking direction in order to securely connect the panels connected in this way, even under load. This can be the case, for example for panels with a thickness greater than or equal to 12 mm, such as laminate or prefabricated parquet panels. Thicknesses greater than or equal to 14 mm, such as 15 mm or 16 mm, are also known, particularly in the case of prefabricated parquet panels with a multi-layer structure.

SUMMARY

This section provides a general summary of the disclosure, and is not a comprehensive disclosure of its full scope or all of its features.

Based on this, it is the object of the disclosure to provide a set consisting of two panels and a panel connection element, which enables a particularly fast, simple and reliable connection of the two panels via the panel connection element with further increased point stability and particularly reliable prevention of the combination of panels from jumping up.

In accordance with the disclosure, a set consisting of two panels for cladding a surface and a panel connection element for connecting the two panels, in particular a floor panel for covering a floor area of a building room, is provided, wherein the panels each comprise a panel core which is enclosed by a flat panel upper surface, a panel lower surface which is spaced apart from the panel upper surface and extends parallel thereto, and four panel side surfaces each connecting the panel upper surface to the panel lower surface, wherein mutually complementary coupling elements in the form of an upper coupling element and a lower coupling element are arranged on two mutually opposing panel side surfaces, which coupling elements are configured in such a way that they enable a coupling of a first such panel to a second such panel by means of a relative movement of the upper coupling element of the first panel toward the lower coupling element of the second panel, wherein the lower coupling element comprises a latching receptacle and the upper coupling element comprises a locking element, which engages in the latching receptacle in the coupled state of the two panels, so that the locking element forms a first coupling section of the coupling elements with the latching receptacle, wherein the lower coupling element comprises a groove adjacent to the latching receptacle, the panel connection element comprises a first part and a second part coupled to the first part via a connecting web, wherein the first part is inserted into the groove in the coupled state of the two panels, the second part is pivotable relative to the first part about the connecting web, the second part comprises an upper portion comprising a latching element and a lower portion comprising a lever, and the latching element comprises a bulge, such as a wedge-shaped tip, at the distal end, the locking element comprises a contact surface, which abuts against the lever in the coupled state of the two panels, and the locking element comprises a latching receptacle which is complementary to the latching element and in which the bulge of the latching element engages in the coupled state of the two panels, so that the bulge of the latching element forms a second coupling section of the coupling elements with the latching receptacle. Preferably, the bulge of the latching element and the latching receptacle have essentially complementary geometries. For example, as already mentioned, the bulge of the latching element can be formed as a wedge-shaped tip and the latching receptacle can have a shape inverted to the wedge-shaped tip.

It is thus a key point of the disclosure that the panel connection element can be pre-assembled by inserting it into the groove and the locking element exerts a force onto the lever during insertion and pushes this lever back. As a result, the latching element of the panel connection element is pivoted forwards, so that in particular the bulge is pivoted into the latching receptacle of the locking element and the two panels are connected to each other via the panel connection element. Here, a significant advantage of the panel connection according to the disclosure is that the panel connection element does not have to move in the groove in order to effect a connection or locking of the two panels to/with each other. In this way the panel connection element can be adapted to the groove precisely or even with a slight oversize to the groove and a height offset between the panels under load can be avoided.

The first coupling section is formed by the interaction of the locking element and the latching receptacle. The second coupling section is formed by the engagement of the latching element in the latching receptacle. Both coupling sections are formed by form-and/or force-fitting engagement of the respective elements in the associated receptacles.

It has also been shown that a set according to the disclosure consisting of two panels and a corresponding panel connection element can also be easily separated again after connection. Such a simple separation of connected panels is particularly advantageous when disassembling corresponding cladding surfaces, such as floorings. A separation of second panels connected according to the disclosure is thus possible, for example by vertically lifting and tilting the connected panels. In particular, connected panels can be disassembled safely and essentially non-destructively and thus also be reused. This increases the sustainability of corresponding panels and thus offers an ecological and economic advantage.

According to a preferred further development of the disclosure, the lower coupling element comprises a protrusion adjacent to the groove and a second contact surface adjacent to the protrusion and the upper coupling element comprises a third contact surface adjacent to the latching receptacle. Further preferably, the second contact surface and the third contact surface lie flat against each other in the coupled state of the two panels. The upper coupling element can thus be inserted to or into the lower coupling element until the respective contact surfaces of the coupling element contact each other. This facilitates the assembly because it is not necessary to pay attention to how far the panels are inserted into each other. The upper coupling element can simply be inserted into the lower coupling element up to the stop.

In principle, it is possible to lock the coupling element by use of a single locking element and a complementary latching receptacle. According to a preferred further development of the disclosure, the lower coupling element comprises a second locking element at its distal end and the upper coupling element comprises a second latching receptacle, into which the second locking element engages in the coupled state of the two panels, so that the second locking element forms a third coupling section of the coupling elements with the second latching receptacle.

According to a preferred further development of the disclosure, the latching element comprises a rear formation, such as a tip, at the proximal end. The region between the bulge and the rear formation can preferably be in the shape of a circular section, so that the latching element consists of a circular section-shaped region with a front bulge and a rear formation.

Furthermore, the protrusion preferably has a mating surface against which in the coupled state of the two panels the rear formation of the upper section of the latching element rests. In particular, the protrusion can be divided into a proximal part and a distal part. The proximal part is connected to the distal part via an edge over which the latching element slides when it is pivoted into place. Once the latching element has slid over the edge as it pivots, it cannot be moved back. This essentially reflects the principle of a barb. The interaction of the proximal part, the edge and the distal part in this sequence takes the form of an ascending staircase. The edge comprises the mating surface against which the rear formation rests in the coupled state of the two panels. The edge forms a barb that prevents the latching element from folding back and thus enables a constant and secure connection of the panels.

Usually, the panel upper surfaces of two panels are flush in the coupled state of the two panels according to the disclosure. Thus, the locking or connecting mechanism is not visible from the outside in the coupled state of two panels. A flat surface not only ensures an attractive and even appearance, but also has the advantage that edges or similar disturbing factors can be avoided with regard to cleaning. According to a preferred further development, chamfers can be provided in the panel upper surface in the area of the panel edges. One advantage of this design is that a slight vertical offset of the panel edges in relation to each other, which can occur, for example, due to dimensional tolerances or uneven subfloors, is visually concealed, in particular in the case of a point load in the area of the joint between the panels.

According to a further development of the disclosure, the first part of the panel connection element comprises a base element which, in the inserted state, is essentially flush with the groove at all contact sides.

According to a preferred further development of the disclosure, the first part of the panel connection element comprises a base element and a plurality of spaced-apart support elements adjacent to the lower side of the base element, on which the base element is supported in the vertical direction. The support elements serve as feet on which the base element stands. In contrast to a panel connection element, which is flush with the groove at all contact sides in the inserted state, a panel connection element that is supported on feet and does not rest flat against the lower groove side at least at the lower side, the flexibility of the panel connection element is increased. In such an embodiment, 2, 3, 4 or more support elements can be provided, for example. In a further embodiment it can be provided that the thickness of the base element, including the support elements, may be greater than the opening width of the groove and the support elements are bent during insertion so that they exert a restoring force via which the panel connection element is retained in the groove in a force-fit manner.

In principle, the mobility of the connecting web can be ensured by various mechanisms. According to a preferred further development of the disclosure, however, the connecting web is formed by a film hinge. The film hinge ensures the mobility of the second part of the panel connection element while the first part of the panel connection element is inserted immovably in the groove. The second part of the panel connection element can be folded forwards and backwards via the film hinge.

Alternatively, according to a preferred further development of the disclosure, it is provided that the panel connection element is designed in one piece. For this purpose, the material of the panel connection element must be sufficiently elastic. A high hardness of the material ensures the breaking strength at the movable and relatively thin designed connecting web.

According to a preferred further development of the disclosure, the lower end of the lever protrudes into the latching receptacle. This ensures that the lever is freely movable and can be easily actuated by the locking element, which is inserted into the latching receptacle.

In principle, the panel connection element can be made of different materials. However, according to a preferred further development of the disclosure, the panel connection element comprises plastic and/or metal. All plastics which are characterized by their hardness and/or elasticity, such as polyethylene (PE) and/or polypropylene (PP) and/or polyamide (PA) and/or acrylonitrile-butadiene-styrene copolymer (ABS) and/or polyvinyl chloride (PVC) and/or polyethylene terephthalate (PET) and/or polystyrene (PS), can be selected as plastics.

In particular, it is provided that the material thickness of the lower coupling element between the panel lower side and the upper side or the bottom of the first latching receptacle is less than the material thickness of the upper coupling element between the panel upper surface and the lower side or the top of the second latching receptacle. This means a dimensioning according to which the coupling elements are interlocked with each other with less force when joining two panels due to an adapted dimensioning compared to previously known panels and thus tend with reduced risk to material failure or breakage.

Such material failure or breakage usually occurs in areas with high loads and the lowest possible material thickness. The lower coupling element has the lowest material thickness between the panel lower side and the first latching receptacle. The upper coupling element has the lowest material thickness between the panel upper surface and the second latching receptacle. In the following, material thickness refers to a minimum or maximum material thickness in this respective area. If the term material thickness is used, this refers to this definition or arrangement.

According to a further embodiment of the disclosure, the panel connection element can be produced by means of extrusion and/or injection molding. In particular, it may be provided that the panel connection element is manufactured from several different materials, in particular several different plastics. Thus, for example, it may be provided that the base element and a plurality of spaced-apart support elements adjacent to the lower side of the base element are made of a first material, in particular plastic, while the first part and/or the second part are made of a second and/or third material, in particular plastic. Here, the first, second and possibly third material may differ in their material properties, such as modulus of elasticity, flexural modulus, hardness, impact strength or the like.

According to a further embodiment of the disclosure, it may be provided, for example, that the connecting web between the first part and the second part of the panel connection element together with the base element are made of a material with a lower modulus of elasticity than that of the material from which the first part and/or the second part of the panel connection element are made, whereas the first part and/or the second part of the panel connection element are made of a material with a higher hardness. This makes it possible to advantageously achieve that the first and/or second part of the panel connection element can be pivoted more easily due to the higher elasticity of the connecting web, but on the other hand, due to the higher hardness of the material from which the first and/or second part of the panel connection element are made, a higher locking force is achieved compared to the coupling elements. This, in turn, can reduce the force required to establish the connection between two panels during installation and at the same time ensure sufficient locking forces which prevent the panels from sliding apart under load.

According to a further embodiment, it may be provided that one part of the panel connection element is manufactured by extrusion, while another part is manufactured by injection molding. Thus, for example, it may be provided that the first and/or second part of the panel connection element is manufactured by extrusion and the connecting web and/or the base element is molded onto the first and/or second part by injection-molding. In this respect, it may be provided that parts of the panel connection element are provided as semi-finished products by means of extrusion and these are completed to form the final panel connection element by molding the other elements by injection-molding.

According to a further embodiment of the disclosure, it may be provided that the panel connection element is manufactured by coextrusion of different materials.

Depending on the desired area of application of the panels, these can be made of different materials. In particular, the panel can comprise a carrier and a decorative layer applied thereon. Here, the material of the carrier can be selected depending on the area of application. For example, the carrier can be made of wood or a wood-based material, provided the decorative panel is not exposed to excessive moisture or weather conditions. If, on the other hand, the panel is intended to be used e.g. in damp rooms or outdoors, the carrier can be made of a plastic or a mineral or ceramic material, for example.

In this context, wood-based materials in the sense of the disclosure are, in addition to solid wood materials, materials such as cross-laminated timber, glue-laminated timber, blockboard, veneered plywood, laminated veneer lumber, parallel strand lumber and bending plywood. In addition, wood-based materials in the sense of the disclosure are also chipboards such as pressboards, extruded boards, oriented structural boards (OSB) and laminated strand lumber as well as wood fiber materials such as wood fiber insulation boards (HFD), medium hard and hard fiberboards (MB, HFH) and in particular medium density fiberboards (MDF) and high density fiberboards (HDF). Even modern wood-based materials such as wood polymer materials (wood plastic composite, WPC), sandwich boards made of a lightweight core material such as foam, rigid foam or honeycomb paper and a layer of wood applied thereto, and minerally bonded, for example with cement, chipboards are wood-based materials in the sense of the disclosure. Moreover, cork represents a wood-based material in the sense of the disclosure.

Plastic materials which can be used in the manufacture of corresponding panels are, for example, thermoplastic resins such as polyvinyl chloride, polyolefins (for example polyethylene (PE), polypropylene (PP)), polyamides (PA), polyurethanes (PU), polystyrene (PS), acrylonitrile butadiene styrene (ABS), polymethyl methacrylate (PMMA), polycarbonate (PC), polyethylene terephthalate (PET), polyetheretherketone (PEEK), or blends or co-polymerisates thereof. The plastic materials may contain common fillers, for example calcium carbonate (chalk), aluminum oxide, silica gel, quartz flour, wood flour, gypsum. They can also be colored in a known manner. In particular, it may be provided that the carrier material comprises a flame retardant.

Furthermore, the panel can comprise a carrier which comprises a mineral and/or ceramic material or, in particular, consists of such a material.

The disclosure also relates to a panel connection element comprising a first part and a second part coupled to the first part via a connecting web, wherein the second part is pivotable relative to the first part about the connecting web, the second part comprises an upper portion comprising a latching element and a lower portion comprising a lever, and the latching element comprises a bulge at the distal end. Preferred further developments of this panel connection element arise in analogy to the preferred further developments of the sets described above.

Finally, the disclosure also relates to the use of a previously described panel connection element for connecting two panels when cladding a surface.

DRAWINGS

The drawings described herein are for illustrative purposes only of selected embodiments and not all possible implementations, and are not intended to limit the scope of the present disclosure.

In the following, the disclosure is explained in further detail based on a preferred exemplary embodiment with reference to the drawings.

In the drawings.

Corresponding reference numerals indicate corresponding parts throughout the several views of the drawings.

DETAILED DESCRIPTION

Example embodiments will now be described more fully with reference to the accompanying drawings.

Figure 1:
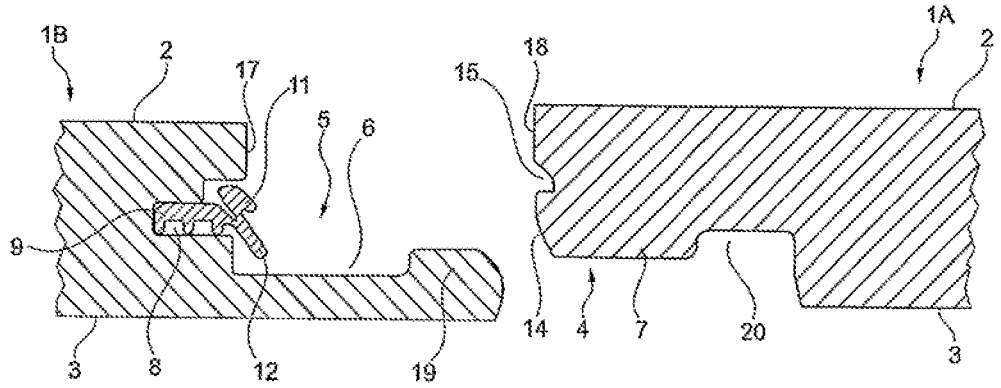
FIG. 1 shows a schematic sectional view of the coupling elements and the panel connection element according to a preferred exemplary embodiment of the disclosure in an uncoupled state.

FIG. 1 shows two panels 1A, 1B in a schematic sectional view, which are provided for cladding a surface. Specifically, the preferred exemplary embodiment of the disclosure shown here involves two floor panels for cladding a floor area of a room of a building. FIG. 1 shows the panels 1A, 1B in an uncoupled state, i.e. separate from one another. The panels 1A, 1B shown here comprise wood, such as in the case of finished parquet or so-called engineered wood, or wood-based materials, such as in the case of laminate, as the base material. Consequently, the carrier comprises wood or a wood-based material, preferably the carrier consists of such a material.

The two panels 1A, 1B each comprise a panel core which is enclosed by a flat panel upper surface 2, a flat panel lower surface 3 spaced therefrom and extending parallel thereto and four panel side surfaces each connecting the panel upper surface 2 to the panel lower surface 3. As can be seen from FIG. 1, complementary coupling elements 4, 5 in the form of an upper coupling element 4 and a lower coupling element 5, which are designed in such a way that they enable a first such panel 1A to be coupled to a second such panel 1B by means of a relative movement of the upper coupling element 4 of the first panel 1A towards the lower coupling element 5 of the second panel 1B, are arranged at two panel side surfaces opposing one another.

The upper coupling element 4 comprises a first locking element 7 and a second latching receptacle 20 adjacent to the locking element 7. At the distal end of the first locking element 7 there is a recess that forms a latching receptacle 15. A contact surface 14 is located below the latching receptacle 15 and directly adjacent to the latching receptacle 15. The lower coupling element 5 comprises a first latching receptacle 6, into which the first locking element 7 of the upper coupling element 4 is inserted. Adjacent to the first latching receptacle 6 at the distal end of the lower coupling element 5 the second locking element 19 is disposed, which is inserted into the second latching receptacle 20 of the upper coupling element 4. Also adjacent to the first latching receptacle 6 but at the proximal end of the coupling element 5 the groove 8 is disposed, into which a panel connection element 9 can be inserted. In the illustrated embodiment of the disclosure, both coupling elements 4, 5 each have a second and a third contact surface 17, 18, respectively, which are disposed adjacent to their panel upper surfaces 2 and abut each other in the coupled state.

The coupling elements 4, 5 are connected via the panel connection element 9. The panel connection element 9 comprises a latching element 11 and a lever 12. In the uncoupled state, the panel connection element 9 can already be pre-assembled by inserting it with its first part I into the groove 8 of the lower coupling element 5 provided for this purpose. The second part II of the panel connection element 9 is disposed in an initial position. The latching element 11 is pivoted back and the lever 12 protrudes accordingly.

By coupling the two coupling elements 4, 5, two or three coupling sections are essentially created.

The first coupling section is created by inserting the locking element 7 into the latching receptacle 6 provided for this purpose. The contact surface 14 of the locking element 7 hits against the lever 12 during insertion and actuates the panel connection element 9 or triggers a pivoting movement of the part of the latching element 9 not located in the locking groove 8. The lever 12 is pushed back and accordingly the latching element 11 is pivoted forward and engages in the complementary latching receptacle 15 of the locking element 7 and establishes the second coupling section. A third coupling section is formed by a further pair of locking element 19 and latching receptacle 20. By bringing the coupling sections 4, 5 together, the second locking element 19, too, is inserted into the latching receptacle 20 provided for this purpose. The first and the third coupling section secure the panels 1A, 1B by preventing a displacement in the horizontal direction or in the longitudinal direction of the panels 1A, 1B. The second coupling section secures the panels 1A, 1B by preventing a displacement in the vertical direction. As a result, the panels 1A, 1B are immovable both in the horizontal and in the vertical direction in the coupled state.

Figure 2:
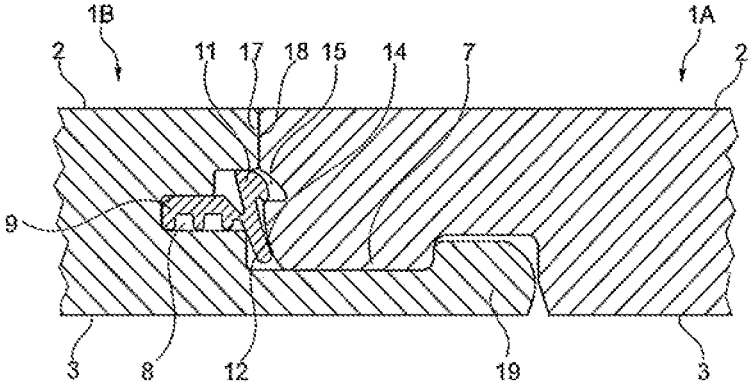
FIG. 2 shows schematically a sectional view of the coupling elements and the panel connection element according to the preferred exemplary embodiment of the disclosure in a coupled state.

FIG. 2 shows in one embodiment of the disclosure the set consisting of the two panels 1A, 1B and the panel connection element 9 in a coupled and fully assembled state. The locking elements 7, 19 are inserted into their respective latching receptacles 6, 20. In this embodiment, the second contact surface 17 of the lower coupling element 5 lies flat against the third contact surface 18 of the upper coupling element 4. The lever 12 has been pushed back by the lower contact surface 14 of the locking element 7. The latching element 11 has been pivoted forward accordingly, so that it is pivoted into the latching receptacle 15 of the locking element 7 and connects or locks the lower coupling area 5 to the upper coupling area 4 in such a way that the two panels 1A and 1B are prevented from moving apart in the vertical direction. The locking between the lower coupling area 5 and the upper coupling area 4, which acts in the vertical direction, only occurs when the movable second part of the panel connection element 9 is actuated, i.e. by pushing back the lever 12 and thus pivoting the latching element 11 into the latching receptacle 15.

Figure 3:
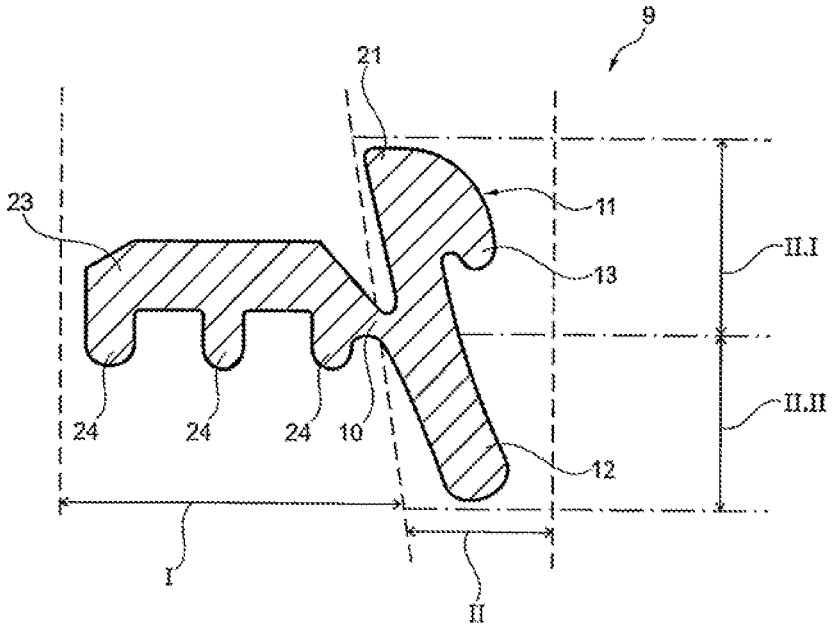
FIG. 3 shows a schematic sectional view of the panel connection element according to a preferred exemplary embodiment of the disclosure in a detailed view.

FIG. 3 shows a sectional view of the panel connection element 9 in a detailed view. The panel connection element 9 can basically be divided into two parts I, II. The first part I is the part that is inserted into the groove 8. The second part II is the movable part. It comprises the latching element 11 and the lever 12. The first part I and the second part II are connected to each other via a connecting web 10. The connecting web 10 is sufficiently thin and elastic to ensure the mobility of the second part II relative to the first part. The second part II can be pivoted about this connecting web 10. The connecting web 10 can also be formed by a film hinge 5 or similar mechanisms.

The first part I is composed of a base element 23 and, in this example, three support elements 24. The support elements 24 serve as a kind of feet on which the base element 23 stands. This design increases the flexibility of the first part I and facilitates the assembly or insertion of the first part I into the groove 8. In addition, such an embodiment leads to material savings compared to an embodiment of the base element 23 as a solid body. It can also be advantageous if the thickness of the base element 23 including the support elements 24 is slightly greater than the opening width of the groove 8. In such an embodiment, the support elements 24 are elastically deformed when the latching element 9 is inserted into the groove 8 and, due to the restoring force caused in this way, create a force-fit connection between the panel connection element 9 and the upper and lower walls of the groove 8, by means of which the panel connection element 9 can be retained within the groove and prevented from slipping out.

The second part II can in turn be divided into an upper section II.I and a lower section II.II. The upper section II.I comprises the latching element 11. The latching element comprises a front bulge 13 and a rear formation 21. The area between the front bulge 13 and the rear formation 21 can preferably be in the shape of a circular section. The lower section II.II comprises the lever 12. The upper section II.I and the lower section II.II are directly coupled to one another by being formed in one piece. A one-piece configuration within the sense of the disclosure also includes those in which the panel connection element 9 is manufactured from different materials, for example in the course of coextrusion of different plastics. In particular, it may be provided that the latching element 11 and the lever 12 are formed from a less elastic plastic material, whereas the connecting web 10 and/or the support elements 24 are formed from a more elastic plastic material. Pivoting the lever 12 inevitably causes the latching element 11 to pivot. The pivoting movement occurs in an arc around the connecting web 10. Due to the fact that the connecting web 10 lies at a level between the upper section II.I and the lower section II.II, the latching element 11 and the lever 12 move in opposite directions. This means that the latching element 11 is pivoted forward when the lever 12 is pivoted back and vice versa.

Figure 4:
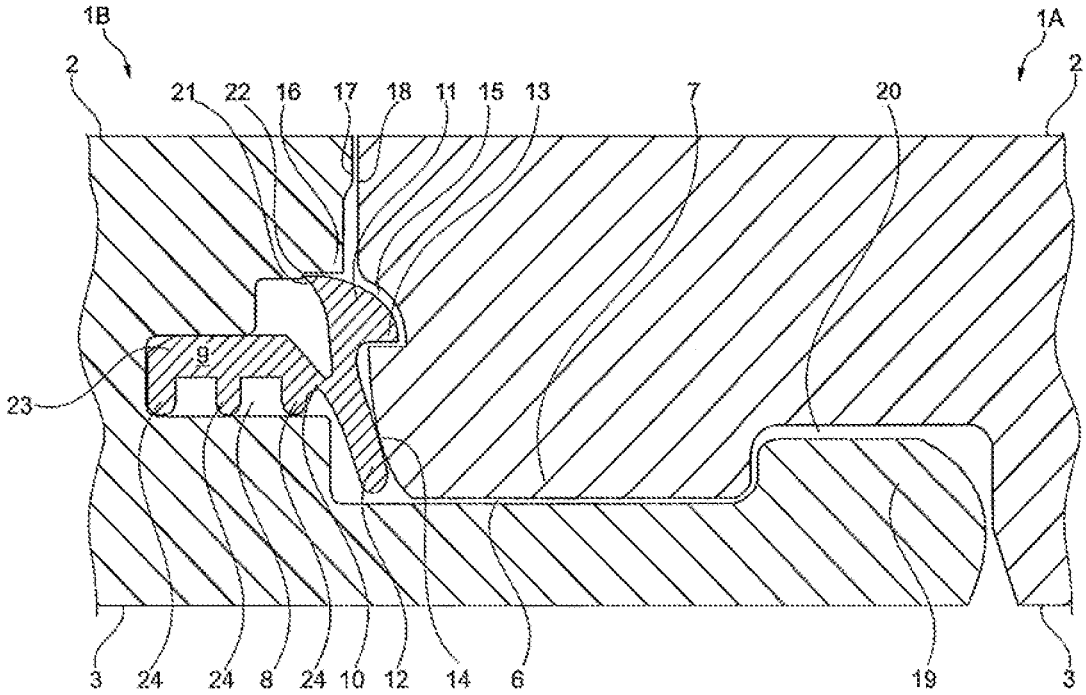
FIG. 4 shows a schematic sectional view of the coupling elements and the panel connection element according to a further preferred exemplary embodiment of the disclosure in a coupled state.

FIG. 4 shows in one embodiment of the disclosure a sectional view of the coupling elements 4, 5 and the panel connection element 9 according to a further preferred exemplary embodiment of the disclosure in a coupled state. The exemplary embodiment shown differs from the exemplary embodiment in FIGS. 1 and 2 in that the lower coupling element 5 comprises a protrusion 16 adjacent to the groove 8. In the protrusion 16 an edge with a mating surface 22 is arranged, against which the rear formation 21 of the latching element 11 abuts. The mating surface 22 of the edge acts as a kind of barb and prevents the latching element 11 from being pivoted back once it has been pivoted forward in the coupled state. In the initial position, the latching element 11 is pivoted back and the rear formation 21 is located behind the edge or behind the mating surface 22. If the latching element 11 is pivoted forward during coupling, the rear formation slides over the edge so that the rear formation 21 abuts against the mating surface 22. In this embodiment of the disclosure, it is no longer possible for the latching element 11 to pivot back. This additionally secures the connection between the lower coupling element 5 and the upper coupling element 4, since the latching element 11 must be pivoted out of the latching receptacle 15 in order to be able to release the connection. However, this is prevented by the mating surface 22 of the protrusion 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A set consisting of two panels for cladding a surface and a panel connection element for connecting the two panels, wherein:

the panels each comprise a panel core which is enclosed by a flat panel upper surface, a flat panel lower surface spaced therefrom and parallel thereto and four panel side surfaces each connecting the panel upper surface to the panel lower surface, at two mutually opposing panel side surfaces mutually complementary coupling elements in the form of an upper coupling element and a lower coupling element are disposed, which are designed in such a way that they enable a coupling of a first such panel to a second such panel by means of a relative movement of the upper coupling element of the first panel towards the lower coupling element of the second panel, the lower coupling element comprises a latching receptacle and the upper coupling element comprises a locking element which engages in the latching receptacle in the coupled state of the two panels, so that the locking element forms a first coupling section of the coupling elements together with the latching receptacle, the lower coupling element comprises a groove adjacent to the latching receptacle, the panel connection element comprises a first part and a second part coupled to the first part via a connecting web, wherein the first part is inserted into the groove in the coupled state of the two panels, the second part is pivotable relative to the first part about the connecting web, the second part comprises an upper section comprising a latching element and a lower section comprising a lever and the latching element comprises a bulge at a distal end of the latching element, wherein the first part of the panel connection element remains substantially stationary in the groove while the second part is pivoted relative to the first part during coupling of the two panels, the locking element comprises a contact surface which abuts against the lever in the coupled state of the two panels, and the locking element comprises a latching receptacle which is complementary to the latching element and in which the bulge of the latching element engages in the coupled state of the two panels, so that the bulge of the latching element forms a second coupling section of the coupling elements together with the latching receptacle.

2. The set according to claim 1, wherein the lower coupling element comprises a second locking element at its distal end and the upper coupling element comprises a second latching receptacle, into which the second locking element engages in the coupled state of the two panels, so that the second locking element forms a third coupling section of the coupling elements together with the second latching receptacle.

3. The set according to claim 1, wherein the lower coupling element comprises a protrusion adjacent to the groove and a second contact surface adjacent to the protrusion and the upper coupling element comprises a third contact surface adjacent to the latching receptacle and the second contact surface and the third contact surface abut flat against one another in the coupled state of the two panels.

4. The set according to claim 1, wherein the panel connection element is arranged substantially stationary in the groove.

5. The set according to claim 1, wherein the latching element comprises a rear formation at the proximal end.

6. The set according to claim 1, wherein the protrusion comprises a mating surface against which, in the coupled state of the two panels, the rear formation of the upper section of the latching element abuts.

7. The set according to claim 1, wherein the panel upper surfaces of two panels terminate flush in the coupled state of the two panels.

8. The set according to claim 1, wherein the first part of the panel connection element comprises a base element and a plurality of mutually spaced support elements which are arranged adjacent to the lower side of the base element and on which the base element is supported in the vertical direction.

9. The set according to claim 1, wherein the connecting web is formed by a film hinge.

10. The set according to claim 1, wherein the panel connection element is designed in one piece.

11. The set according to claim 1, wherein the lower end of the lever projects into the latching receptacle.

* * * * *